United States Patent [19]

Thomas, deceased et al.

[11] Patent Number: 4,604,316

[45] Date of Patent: Aug. 5, 1986

[54] FLUOROCHEMICAL COMPOSITION FOR COATING SOIL RESISTANT YARN

[75] Inventors: Robert H. Thomas, deceased, late of Lexington County; by Mary A. Thomas, executrix, Columbia, both of S.C.; Willis B. Hammond, Chatham, N.J.; Michael P. Friedberger; William A. Archie, both of Petersburg, Va.

[73] Assignee: Allied Corporation, Morris Township, Morris County, N.J.

[21] Appl. No.: 417,970

[22] Filed: Sep. 14, 1982

Related U.S. Application Data

[63] Continuation-in-part of Ser. No. 350,544, Feb. 19, 1982.

[51] Int. Cl.[4] ..... B32B 7/00; C07C 69/76; D06M 13/34

[52] U.S. Cl. ..... 428/265; 252/8.6; 252/8.8; 427/393.4; 428/267; 428/361; 428/362; 428/365; 560/87

[58] Field of Search ..... 427/393.4; 252/8.8, 252/8.6; 560/87; 428/361, 362, 365, 267, 265

[56] References Cited

U.S. PATENT DOCUMENTS 4,193,880 3/1980 Marshall ..... 252/8.8
4,219,625 8/1980 Mares et al. ..... 560/87 X
4,264,484 4/1981 Patel ..... 427/393.4 X
4,346,141 8/1982 Remington ..... 427/393.4 X

*Primary Examiner*—Thurman K. Page
*Attorney, Agent, or Firm*—Richard A. Anderson

[57] ABSTRACT

Improved retention on yarn and processing properties have been discovered in a composition of matter comprising meta and para pyromellitates

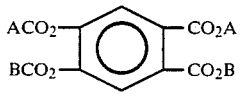

I.

and

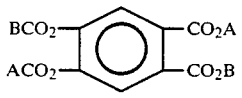

II.

and 70 to 95 percent by weight of specific dimers and other oligomers of I. and II., wherein A is $(CH_2)_2(CF_2)_nCF_3$, where n is 5 to 13 and B is $CH_2CHOHCH_2Cl$.

33 Claims, No Drawings

FLUOROCHEMICAL COMPOSITION FOR COATING SOIL RESISTANT YARN

BACKGROUND OF THE INVENTION

This application is a continuation-in-part of Ser. No. 350,544 filed Feb. 19, 1982.

This invention relates to a new composition of matter, namely a pyromellitate fluorocarbon monomer containing up to 95 percent of its dimer and related oligomers. The new composition is useful in or on fiber to reduce soiling of fabric constructed of the fiber such as carpet, and will remain on fabric after normal wear and repeated washing.

It is known to use the monomer mixture of fluorocarbon meta and para pyromellitates in a yarn finish for nylon and polyester fiber for use in fabric, such as carpet, in U.S. Pat. No. 4,192,754 hereby incorporated by reference. This fluorocarbon is also disclosed in U.S. Pat. No. 4,209,610, hereby incorporated by reference. An improved process to manufacture this fluorocarbon pyromellitate is disclosed in U.S. Pat. No. 4,239,489 and U.S. Pat. No. 4,321,403, also hereby incorporated by reference. An improved fluorocarbon composition is disclosed in U.S. Ser. No. 380,188 filed May 20, 1982 related to the improved composition of this invention.

It was suspected that the previously known fluorocarbon pyromellitate monomer inherently contained small amounts of dimer, considered impurities, which occurred naturally during its manufacture.

As part of an ongoing effort to characterize the components in fluorocarbon compounds, we have detected and assigned several previously unidentified peaks in the proton and carbon-13 nuclear magnetic resonance (NMR) spectra. Based on the mono- and dibenzoate esters of 3-chloro-1,2-propanediol as models we believe that the fluorocarbon compound contains significant amounts of bridging groups which give rise to oligomeric components.

Analysis was done for the 200 MHz proton NMR spectrum of a representative commercial fluorocarbon compound prepared by one supplier in 1980. This spectrum was run under new conditions (10 weight percent solution in trifluoroacetic anhydride containing 15–20 percent benzene-$d_6$) which resolve a small peak at 5.65 ppm from a larger peak at 5.45 ppm. The peak at 5.45 ppm has been previously assigned to the proton on the C-2 carbon of the 3-chloro-2-hydroxy-1-propyl ester in the fluorocarbon compound. The peak at 5.65 ppm we believe is due to the diester of 3-chloro-1,2-propanediol which bridges two fluorocarbon compound monomeric units to give oligomers. A shoulder at 4.75 ppm and a peak at 3.8 ppm have counter-parts in the model compound 3-chloro-1,2-propanediol dibenzoate (I) further supporting the proposed bridge structure. Their intensities parallel the intensity of the 5.65 ppm resonance.

It is possible to calculate the amount of oligomer in the fluorocarbon compound if we accept that the peak at 5.65 ppm is attributable to the bridging unit. The calculation is simplified if we assume that the oligomer is predominantely dimer with three 3-chloro-2-hydroxy-1-propyl ester groups for each bridge group. For the above sample we detect 27 mole percent oligomer as dimer. For other fluorocarbon compound samples prepared by this supplier, values between 18 and 30 percent oligomer calculated as dimer are found. Similar values were found for laboratory samples prepared by our standard procedure.

Further evidence for the bridging group in the fluorocarbon compound is found in the $^{13}C$ NMR of the fluorocarbon compound in acetone-$d_6$. Peaks at 42.9, 64.7 and 73.1 ppm in the $^{13}C$ NMR of the fluorocarbon compound have chemical shifts very similar to the corresponding carbons in model compound I and have been attributed to the bridging group. These peaks are easily resolved from the peaks at 45.5, 67.2 and 69.4 ppm assigned to the 3-chloro-2-hydroxy-1-propyl ester unit of fluorocarbon compound. Quantitatively the ratio of bridging groups to 3-chloro-2-hydroxy-1-propyl groups measured by $^{13}C$ NMR agrees very closely with the values obtained by proton NMR.

However, a change in the manufacturing process by another supplier of the fluorocarbon pyromellitate produced a product which in use in finish on nylon fiber for carpets suddenly had different properties, discovered by the inventors. The inventors also analyzed the fluorocarbon pyromellitate and the yarn to discover its composition and the surprising properties of yarn having a finish containing the inventive composition.

SUMMARY OF THE INVENTION

This invention is a composition of matter comprising 5 to 30 percent by weight of fluorocarbon compounds of a mixture of meta and para pyromellitates having the structure

I.

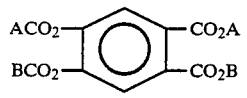

and

II.

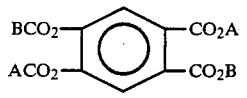

and 70 to 95 percent by weight of fluorocarbon compounds of a dimer of the same pyromellitates selected from the group consisting of

III.

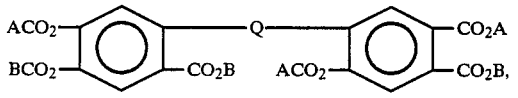

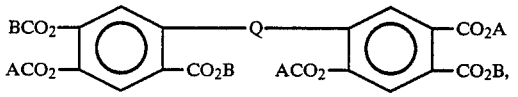

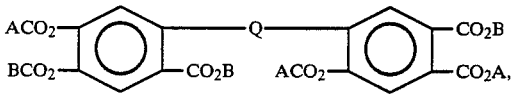

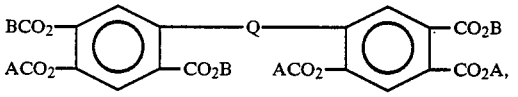

-continued

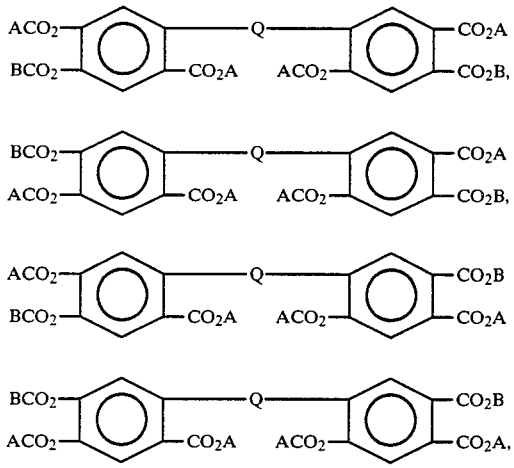

and related oligomers,
and mixtures thereof, (end of III.)
wherein Q is

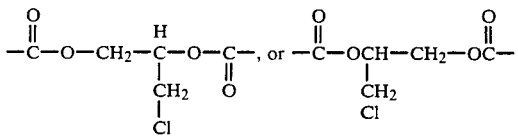

or
wherein A is $(CH_2)_2(CF_2)_nCF_3$ where n is 5 to 13 and B is $CH_2CHOHCH_2Cl$, and/or

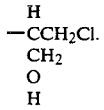

The related oligomers are trimers, tetramers and the like wherein 3 or more of the above substituted benzene rings are connected with bridging groups identical to those labeled Q above, in all the various combinations available. This composition can be emulsified to be incorporated into a finish which can be used as a spin finish or other type finish to coat yarn. The preferred yarn is nylon or polyester. The preferred composition is 80 to 90 percent of the dimers and related oligomers labelled "III".

This invention is also a yarn finish composition comprising (a) about 15 to 80 percent by weight of a solution of a salt of dioctylsulfosuccinate, propylene glycol and water, and (b) the composition described above by "I", "II", and "III". Component (a) above is the preferred emulsifier and is taught in U.S. Pat. No. 4,192,754. However, a yarn finish could also be applied containing only the composition above without previously emulsifying it, as in a solvent based finish. Also, the yarn could contain a small amount of the composition of this invention in the fiber polymer as in a melt blend of the composition described above.

DESCRIPTION OF THE PREFERRED EMBODIMENT

Beginning in September, 1981, batches of the fluorocarbon pyromellitate from one supplier appeared to have different characteristics, including better oil repellency, better retention on fiber, different crimping characteristics during processing of yarn to staple nylon 6 fiber, and better direct cabling for continuous filament yarn.

After discovery of these different performance characteristics, analysis for chemical characteristics has provided a theory that the supplier's proprietary process, using methyl isobutyl ketone (MIBK) solvent and a final step adding 1 to 2 percent emulsifier of sodium lauryl sulfate and possibly Triton X-100 surfactant, creates over 75 percent dimer and related oligomers and about 3 to 6 percent free fluoroalcohol in the fluorocarbon pyromellitate product. Previously only small amounts of dimer were suspected in the product.

Speculation is that the use of MIBK solvent and different conditions creates more dimer.

The product supplied by the proprietary process is used as described in U.S. Pat. No. 4,192,754 above wherein the product is the "first noncontinuous phase". The resulting finish is applied as a conventional spin finish.

NMR (nuclear magnetic resonance spectroscopy) analysis confirms that the structure is the dimers and related oligomers of this invention (III), and is present in an amount of about 80 to 90 percent of the fluorocarbon compounds. Previously high performance liquid chromatography and size exclusion chromatography had shown presence of new higher molecular weight components in the product fluorocarbon pyromellitate from this one supplier. The inventors, before that, discovered the product from this supplier had changed to consistently higher (better) oil resistance rating (by the technique of A.A.T.C.C. Test No. 118-1975), see U.S. Pat. No. 4,192,754 above, than previous product and better than product from another supplier, as shown in Tables I. and II. The high dimer and related oligomers content material was first knowingly introduced in September, 1981.

TABLE I

| Month | Average Rating |
|---|---|
| August | 4.40 |
| September | 4.70 |
| October | 4.95 |
| November | 5.26 |
| December through 14th | 5.10 |

Also, during processing of yarn coated with a finish (described above) containing the composition of this invention, the crimp level of the yarn processed as disclosed in U.S. Pat. No. 3,266,082 and U.S. Pat. No. 4,095,318 both hereby incorporated by reference surprisingly had a higher crimp level, 11 crimps per inch (cpi) as opposed to the previous 10 cpi. Adjustment of the draw rollers back to 10 cpi allowed the speed of the initial or nip rolls to be reduced from about 245 to about 207 rpm which is more easily controllable. Also the pressure on the hinged outlet flap of the crimp box was lowered from about 48 to about 25 psig, also more easily controlled and a less harsh treatment of yarn.

After inventors' discoveries of different properties, the supplier was contacted and furnished the following data in Table II regarding retention of the fluorocarbon product on fabric. Inventors discovered that lots 8, 11 and 12 contain high percentages of dimer and related oligomers. The other lots are comparative.

TABLE II

| Lot | Initial (PPM-F)* | After Washing (PPM-F)** | Percent Flourine Retained |
|---|---|---|---|
| 2 | 1,220 | 300 | 24.65 |
| (prior art) | 890 | 220 | |
| 7 | 1,150 | 380 | 33.00 |
| (prior art) | | | |
| 8 | 1,350 | 560 | |
| | 1,240 | 530 | |
| | 1,270 | 520 | 43.16 |
| | 1,180 | 540 | |
| | 1,070 | 480 | |
| 9 | 1,190 | 450 | 38.9 |
| (prior art) | 1,150 | 460 | |
| 10 | 1,250 | 510 | 40.8 |
| (prior art) | | | |
| 11 | 1,110 | 490 | 43.05 |
| | 880 | 370 | |
| 12 | 1,060 | 520 | 48.25 |
| | 950 | 450 | |
| another | 1,340 | 270 | |
| prior art | 1,010 | 260 | 23.8 |
| product | 1,170 | 300 | |

*Parts per million of fluorine.

**Standard A.A.T.C.C. home wash tumble dry durability test.

We claim:

1. A composition of matter comprising 5 to below 70 percent by weight of fluorocarbon compounds of a mixture of meta and para pyromellitates having the structure

I.

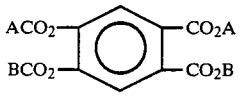

and

II.

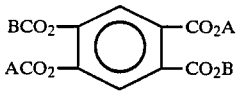

and above 30 to 95 percent by weight of fluorocarbon compounds of a dimer of the same pyromellitates selected from the group consisting of

I.

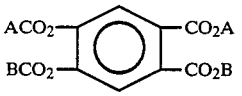

and

II.

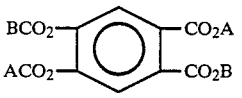

and related oligomers, and mixtures thereof, wherein Q is

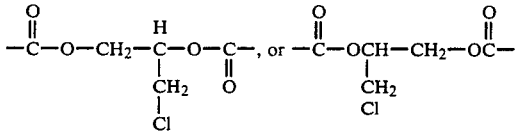

wherein A is $(CH_2)_2(CF_2)_nCF_3$ where n is 5 to 13 and B is $CH_2CHOHCH_2Cl$, and/or

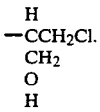

2. The composition of claim 1 in an emulsion.

3. A yarn finish containing the emulsion of claim 2.

4. Yarn coated with the finish of claim 3.

5. The yarn of claim 4 wherein the yarn is nylon.

6. The yarn of claim 4 wherein the yarn is polyester.

7. The composition of claim 1 wherein 80 to 90 percent of the composition is III.

8. The composition of claim 7 in an emulsion.

9. A yarn finish containing the emulsion of claim 8.

10. Yarn coated with the finish of claim 9.

11. The yarn of claim 10 wherein the yarn is nylon.

12. The yarn of claim 10 wherein the yarn is polyester.

13. A yarn finish composition comprising a. about 15 to 80 weight percent of a solution of a salt of dioctyl sulfosuccinate, propylene glycol and water, b. the composition of claim 1.

14. Yarn coated with the finish of claim 13.

15. The yarn of claim 14 wherein the yarn is nylon.

16. The yarn of claim 14 wherein the yarn is polyester.

17. A yarn finish composition comprising a. about 15 to 80 weight percent of a solution of a salt of dioctyl sulfosuccinate, propylene glycol and water, b. the composition of claim 7.

18. Yarn coated with the finish of claim 17.

19. The yarn of claim 18 wherein the yarn is nylon.

20. The yarn of claim 18 wherein the yarn is polyester.

21. A yarn finish containing the composition of claim 1.

22. Yarn coated with the finish of claim 21.

23. The yarn of claim 22 wherein the yarn is nylon.

24. The yarn of claim 22 wherein the yarn is polyester.

25. Yarn containing the composition of claim 1.

26. Yarn of claim 25 wherein the yarn is nylon.

27. Yarn of claim 25 wherein the yarn is polyester.

28. The method of coating yarn comprising coating polyamide yarn with the composition of claim 1.

29. The method of coating yarn comprising coating polyester yarn with the composition of claim 1.

30. The method of coating yarn comprising coating polyamide yarn with the composition of claim 8.

31. The method of coating yarn comprising coating polyester yarn with the composition of claim 8.

32. The method of coating yarn comprising coating polyamide yarn with the composition of claim 13.

33. The method of coating yarn comprising coating polyamide yarn with the composition of claim 17.

* * * * *

UNITED STATES PATENT AND TRADEMARK OFFICE

CERTIFICATE OF CORRECTION

PATENT NO. : 4,604,316

DATED : August 5, 1986

INVENTOR(S) : Robert H. Thomas, Deceased; Willis B. Hammond; Michael P. Friedberger; and William A. Archie It is certified that error appears in the above-identified patent and that said Letters Patent is hereby corrected as shown below:

In claim 1

Col., 5, lines 53 through 64 should be deleted and replaced as follows:

III.

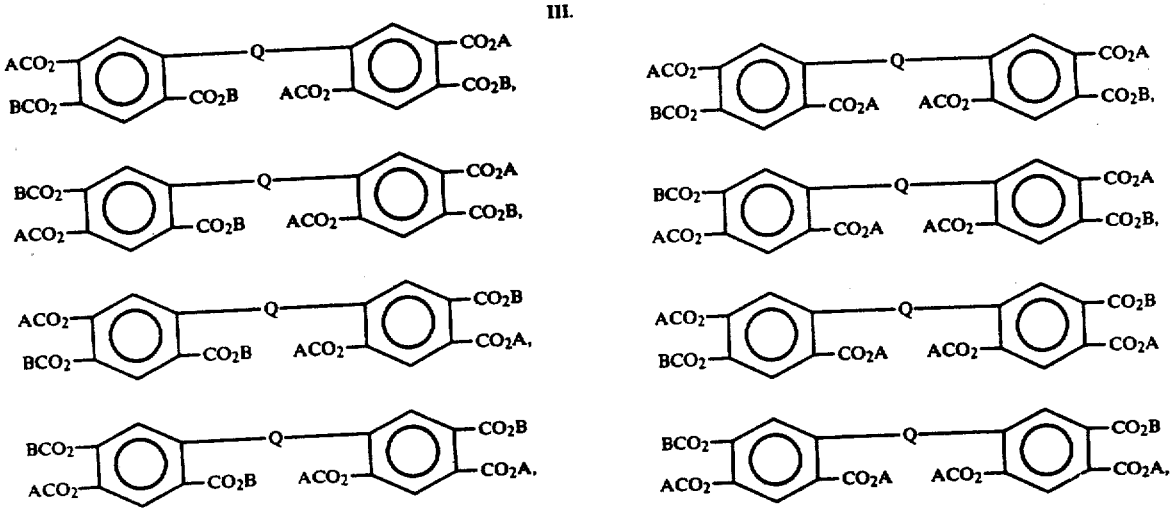

Signed and Sealed this

Twenty-first Day of October, 1986

[SEAL]

*Attest:*

DONALD J. QUIGG

*Attesting Officer*

*Commissioner of Patents and Trademarks*